US005137006A

United States Patent [19]

Gallops

[11] Patent Number: 5,137,006

[45] Date of Patent: Aug. 11, 1992

[54] ARROW REST FOR AN ARCHERY BOW

[75] Inventor: Henry M. Gallops, Melrose, Fla.

[73] Assignee: Bear Archery Inc., Gainesville, Fla.

[21] Appl. No.: 352,371

[22] Filed: May 16, 1989

[51] Int. Cl.[5] ..... F41B 5/22

[52] U.S. Cl. ..... 124/44.5; 124/24.1

[58] Field of Search ..... 124/41 A, 24 R, 44.5, 124/24.1

[56] References Cited

U.S. PATENT DOCUMENTS

| | | | |
|---|---|---|---|
| 3,318,298 | 5/1967 | Bear . | |
| 3,865,096 | 2/1975 | Troncoso, Jr. | 124/24 R |
| 3,890,951 | 6/1975 | Jennings et al. | 124/41 A |
| 3,935,854 | 2/1976 | Troncoso, Jr. | 124/24 R |
| 4,664,093 | 5/1987 | Nunemaker | 124/24 R |
| 4,686,956 | 8/1987 | Troncoso, Jr. | 124/41 A |
| 4,715,355 | 12/1987 | Lattig | 124/41 A |
| 4,803,971 | 2/1989 | Fletcher | 124/24 R X |
| 4,827,895 | 5/1989 | Troncoso, Jr. | 124/41 A |
| 4,838,237 | 6/1989 | Cliburn | 124/24 R X |

*Primary Examiner*—Peter M. Cuomo

*Attorney, Agent, or Firm*—Milton Wolson

[57] ABSTRACT

An improved arrow rest for an archery bow comprises an arm adjustably mounted to the bow handle and a vertically depressable arrow launcher support connected to the arm, and moveable to and from the arm by a shuttle. The top portion of a "U" shaped spring engages the area around the top surface of the shuttle and the bottom portion of the spring engages the bottom surface of the arrow launcher support to bias it upwardly. Slots or grooves are provided for varying the length of the spring that engages the area around the top surface of the shuttle and the bottom surface of the arrow launcher support, whereby the amount of vertical depressability of the arrow launcher support is dependent upon the length of the spring that engages the area around the top surface of the shuttle and the bottom surface of the arrow launcher support. Spring members of various stiffness can also be utilized to increased the range of vertical stiffness of the arrow support.

7 Claims, 4 Drawing Sheets

ARROW REST FOR AN ARCHERY BOW

CROSS-REFERENCES TO RELATED APPLICATIONS

There are no related applications.

STATEMENT AS TO RIGHTS TO INVENTIONS MADE UNDER FEDERALLY SPONSORED RESEARCH AND DEVELOPMENT

The invention disclosed and claimed herein was not made under any federally sponsored research and development program.

BACKGROUND OF THE INVENTION (1) Field of the Invention

The present invention pertains generally to archery equipment and more particularly to an improved arrow rest for an archery bow.

(2) Description of the Prior Art

Arrow rests for archery bows are devices which are utilized to stabilize the arrow before it is released from the bow. Such arrow rests are typically located on a lateral extension of the mid portion of the bow and permit the archer to accurately aim and shoot the arrow from the bow.

One such arrow rest is disclosed in U.S. Pat. No. 3,935,854 issued to Troncosco. This patent teaches that arrow accuracy is increased when the vertical depressability of the arrow rest arms effectively dampens the vertical oscillation of the arrow. The vertical depressability of the Troncosco arrow rest arms may be achieved by forming the arms of a strip of metal wire or plastic wire. Recognizing the desirability of adjusting the vertical spring action of the arrow rest arms, the patent states that the arrow rest arms may include one or more coils to increase the vertical spring action (column 4, lines 60 to 64). It will be noted, however, that the adjustment of the vertical spring action of the arrow rest arms in this manner is an inherent characteristic of the arrow rest arms structure and such spring action adjustment is not controllable by the archer.

U.S. Pat. No. 4,664,093 issued to Nunemaker discloses another form of arrow rest. This device includes an arrow launcher support comprising a relatively thin metal strip having a rectangular-shaped portion at one end and a U-shaped notch at the other end for supporting an arrow shaft. Here again, the archer is unable to adjust the vertical spring action of the arrow launcher support.

SUMMARY OF THE INVENTION

In the type of arrow rest to which the present invention is directed, the amount of vertical arrow deflection is controllable by the amount of vertical depressability of the arrow launcher support. Since the amount of such vertical arrow deflection is influenced by the particular bow, arrow, and archer, it is desirable that the archer be able to control the amount of such vertical depressability and thereby the amount of deflection of the arrow during launch.

Thus, the present invention is concerned with an improved arrow rest of the type in which arrow accuracy is increased by the vertical depressability of an arrow launcher support and wherein means are provided to enable the archer to control the amount of such vertical depressability.

The present invention is equally adaptable for use with both right and left handed archery bows and is designed so as to permit the archer to adjust the amount of vertical depressability of the arrow launcher support in an easy, rapid manner. Further features of the invention are set forth in the following detailed description and accompanying drawings.

BRIEF DESCRIPTION OF THE DRAWINGS

A further understanding of the present invention may be had when the following detailed description is read in conjunction with the accompanying drawings in which.

DETAILED DESCRIPTION OF THE PREFERRED EMBODIMENT

Figure 1:
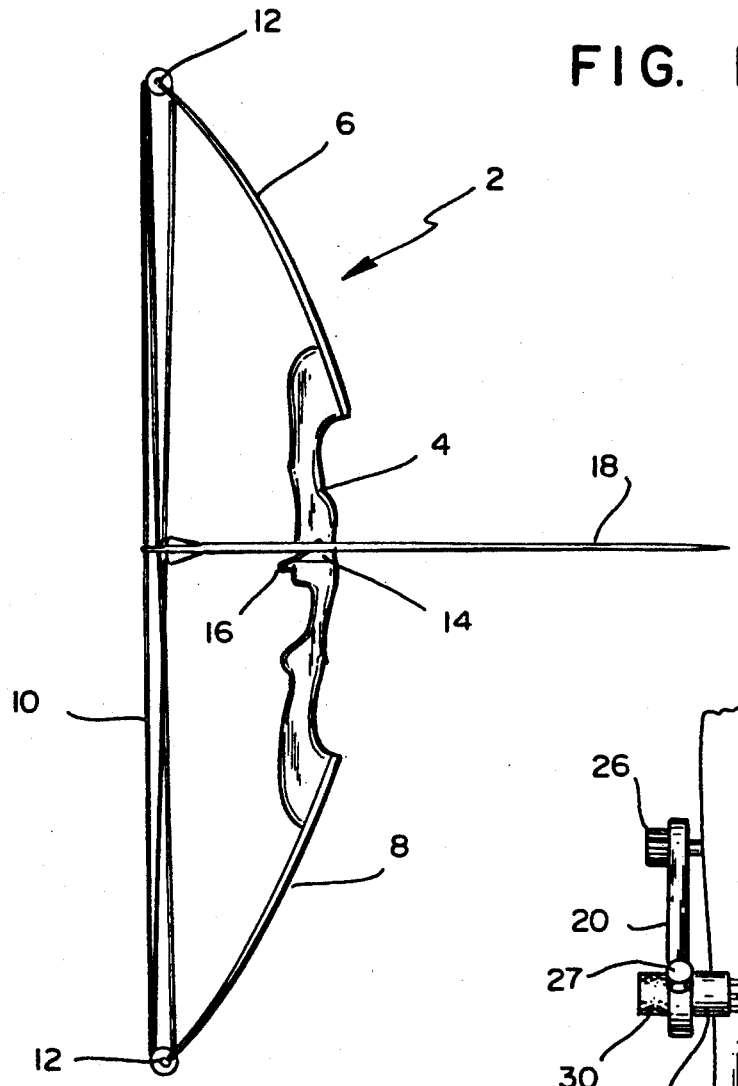
FIG. 1 is a side elevation view of the improved arrow rest of the present invention attached to an archery bow and supporting an arrow.
Figure 3:
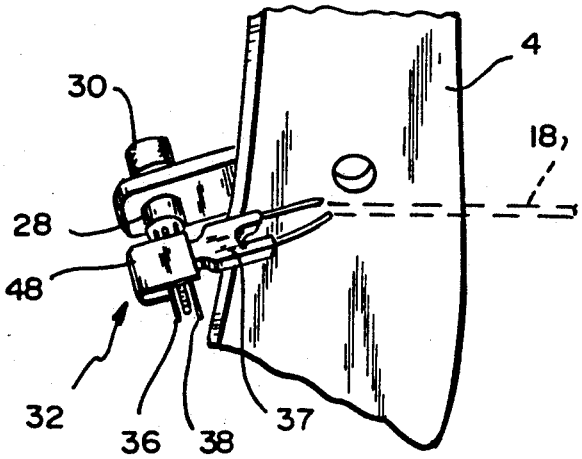
FIG. 3 is a partial side elevation view showing the arrow rest of the present invention mounted on the bow handle.

In FIG. 1, there is shown a compound bow 2 having a handle 4, an upper limb 6 and a lower limb 8. A bowstring 10 surrounds and is carried by pulleys 12 connected to upper limb 6 and lower limb 8 of compound bow 2 in known manner. Bow handle 4 includes an arrow rest area 14 on which the improved arrow rest, shown generally as 16, is mounted. An arrow 18 has its shaft nocked to bowstring 10. The location of the arrow rest 16 with respect to the bow handle 4 is illustrated in FIG. 1 and FIG. 3. Although a compound bow is illustrated, the present invention may be used with other bows as well.

Figure 2:
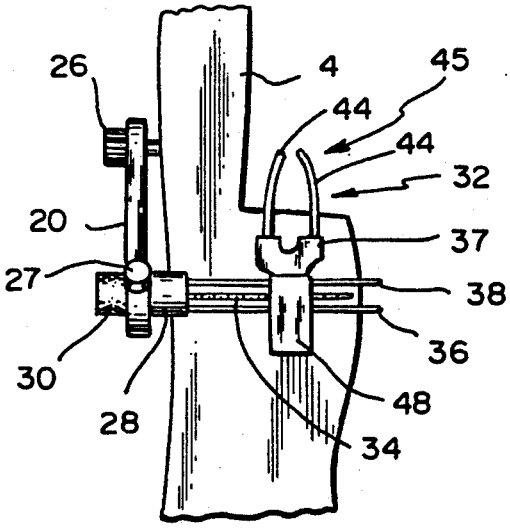
FIG. 2 is a partial rear elevation view showing the arrow rest of the present invention mounted on the bow handle.
Figure 4:
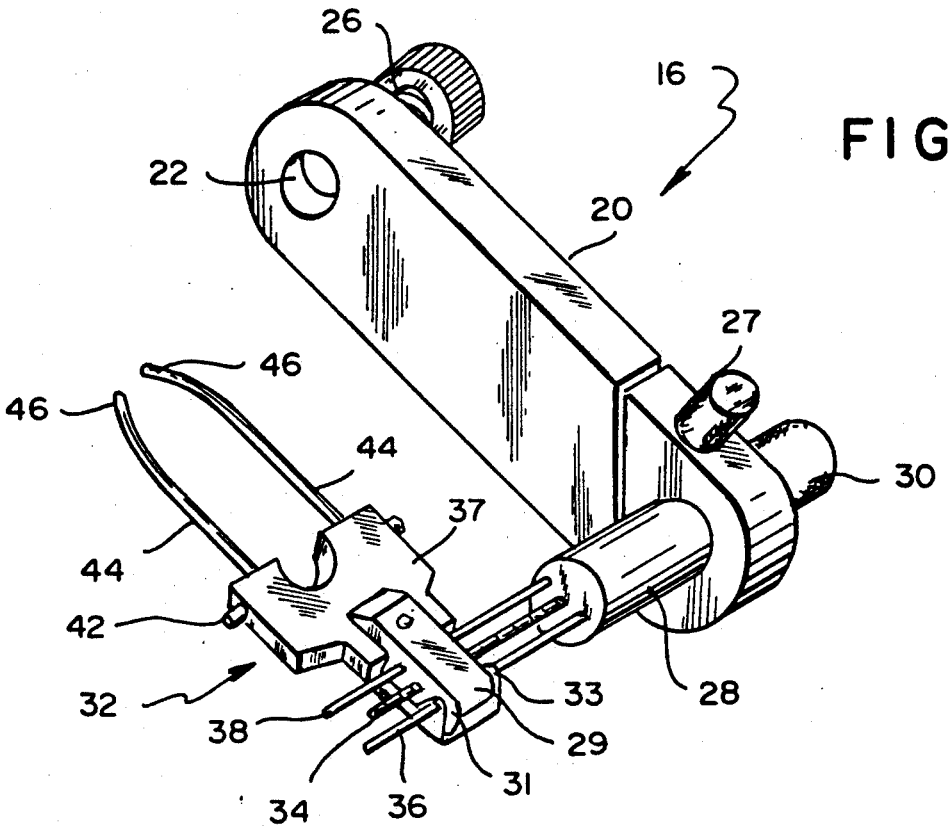
FIG. 4 is a perspective view showing the arrow rest of the type to which the present invention is directed but without the means permitting the archer to control the amount of vertical depressability of the arrow rest launcher support.
Figure 5:
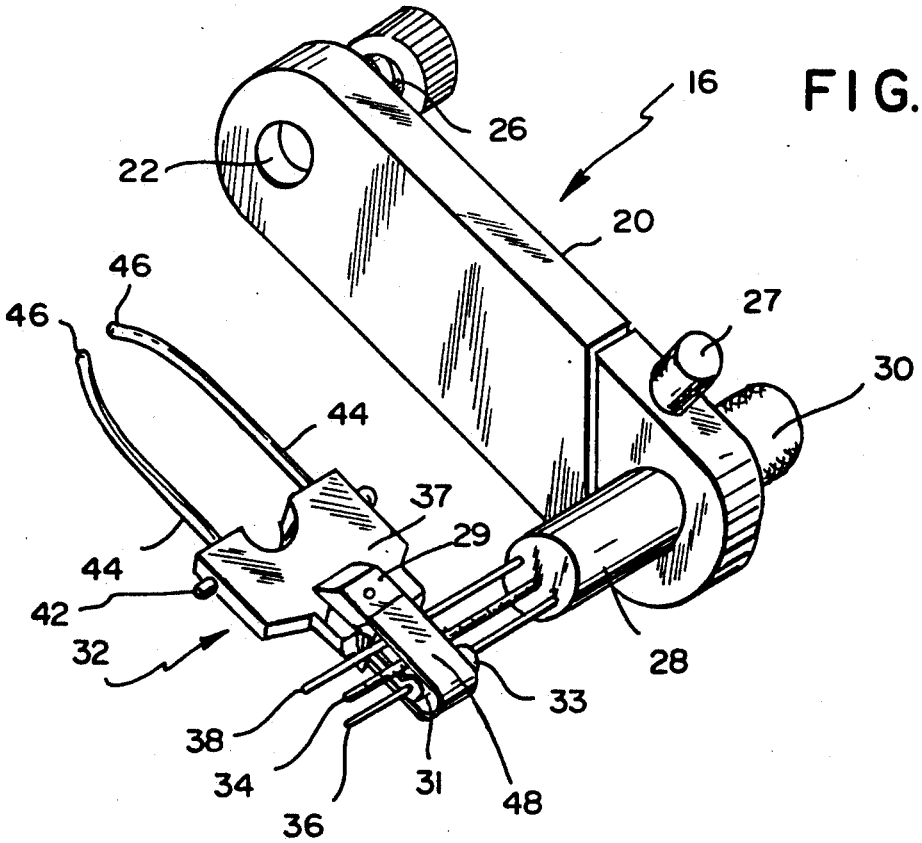
FIG. 5 is a perspective view showing the improved arrow rest of the present invention.

As shown in FIG. 4, arrow rest 16 comprises an arm 20, having an opening 22 therein. A bolt 26 or other threaded means extends through opening 22 to secure the arrow rest 16 to an opening in bow handle 4, as shown in FIG. 2. The archer may select the angle at which arrow rest 16 may be secured to the bow handle. A rotatable rod assembly 28 extends through an opening in arm 20. One end of rod assembly 28 has a knurled knob 30 which is rotatable in either direction to move a shuttle 29 toward and away from arm 20. Shuttle 29 is located within upstanding arms 31 and 33 connected to arrow launcher support 32 in such a manner that arrow launcher support 32 is moved toward arm 20 when shuttle 29 is moved toward arm 20, and arrow launcher support 32 is moved away from arm 20 when shuttle 29 is moved away from arm 20.

Rod assembly 28 has a threaded member 34 extending therefrom. Threaded member 34 extends through a threaded hole in shuttle 29 so that counterclockwise rotation of knurled knob 30, which is fastened to threaded member 34, causes movement of shuttle 29 and arrow launcher support 32 in one direction with respect to arm 20, and clockwise rotation of knurled knob 30 of rod assembly 28 causes movement of shuttle 29 and arrow launcher support 32 in the opposite direction from arm 20. In this manner, the archer is able to adjust the location of the arrow launcher support 32 with respect to bow 2.

The angular position of the arrow launcher support 32 with respect to the arm 20 (and bow handle 4) may also be adjusted to the position most advantageous to the archer. More specifically, rod assembly 28 is rotatable within arm 20 to any angular position desired by the archer. After selecting a particular desired angular position, a lock screw 27, extending through a threaded opening in the top surface of arm 20 and through an angular groove in the rotatable rod assembly 28, is tightened by the archer to secure rod assembly 28 in the desired angular position.

Figure 6:
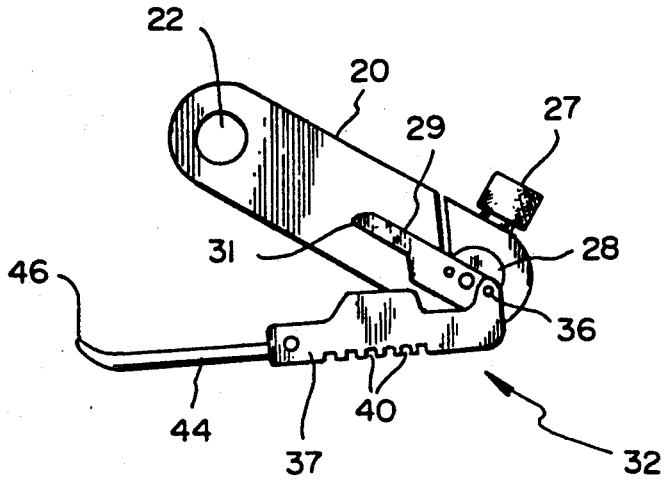
FIG. 6 is a side elevation view showing the arrow rest of the type to which the present invention is directed but without the means permitting the archer to control the amount of vertical depressability of the arrow launcher support.

A pivot member 36 also extends from rotatable rod assembly 28. Pivot member 36 extends into an opening in shuttle 29 and into a rear portion of a base member 37 of arrow launcher support 32 so that arrow launcher support 32 is pivotable about pivot member 36 as shown in FIG. 6. A post 38 extends from rotatable rod assembly 28 into an opening in shuttle 29 and prevents shuttle 29 from pivoting about pivot member 36 and in this manner pivot member 36 and post 38 act as guide members for shuttle 29.

The base member 37 of arrow launcher support 32 includes a number of grooves 40 on the bottom surface. The number of grooves 40 may vary in accordance with the amount of desired vertical depressability of arrow launcher support 32 in a manner to be described. The arrow launcher support 32 includes an arrow support 45 comprising two elongated members 44 having inwardly and upwardly directed ends 46, connected to the base member 37 which support the arrow preparatory to launch. The elongated members 44 fit slidingly into openings in base member 37 so that the length of the elongated members 44 extending from the base member 27 may be adjusted to the length desired by the archer. When the desired length is selected, the archer may lock the elongated members 44 in base member 27 by means of set screw 42. Various type arrow supports may be used to support the arrow preparatory to launch including, for example, a single support arm extending from the arrow launcher support 32 and having a V-shaped notch at the end thereof for supporting the arrow.

Figure 9A:
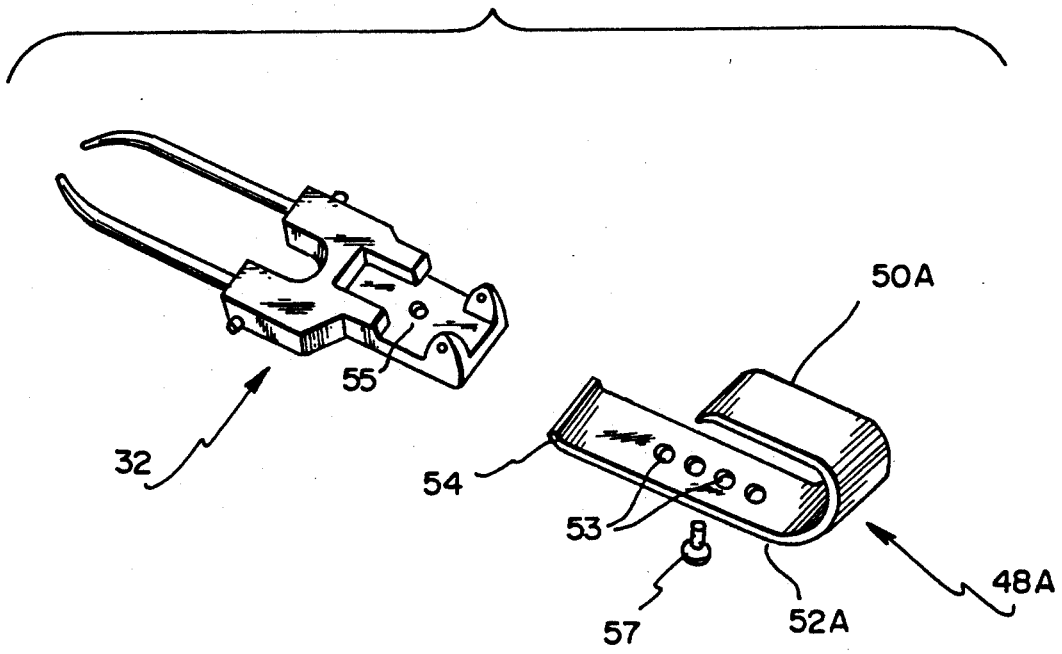
FIG. 9A is a second embodiment of a spring means permitting the archer to control the amount of vertical depressability of the arrow launcher support and a partial view of the arrow launcher support.
Figure 9:
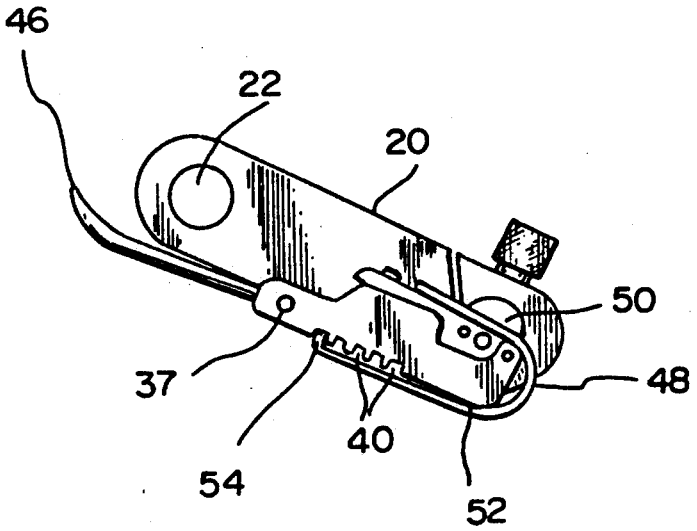
FIG. 9 is a first embodiment of a spring means permitting the archer to control the amount of vertical depressability of the arrow launcher support.

A generally U-shaped spring means 48, as shown in FIG. 9, is employed to maintain arrow launcher support 32 in the same angular orientation as shuttle 29. Spring means 48 includes an upper portion 50 and a lower portion 52 having an upturned finger 54 for maintaining the arrow launcher support 32 parallel to the launcher shuttle 29 prior to arrow launch. More specifically, upper portion 50 of U-shaped spring means 48 engages the area around the top surface of shuttle 29, and an upturned finger 54 of lower portion 52 of U-shaped spring means 48 engages one of the slots 40 on the lower surface of base member 37 of arrow launcher support 32 to bias arrow launcher support 32 upwardly toward shuttle 29. In this manner, the arrow launcher support 32 may be maintained under pressure against the shuttle 29 until the arrow is released.

Figure 7:
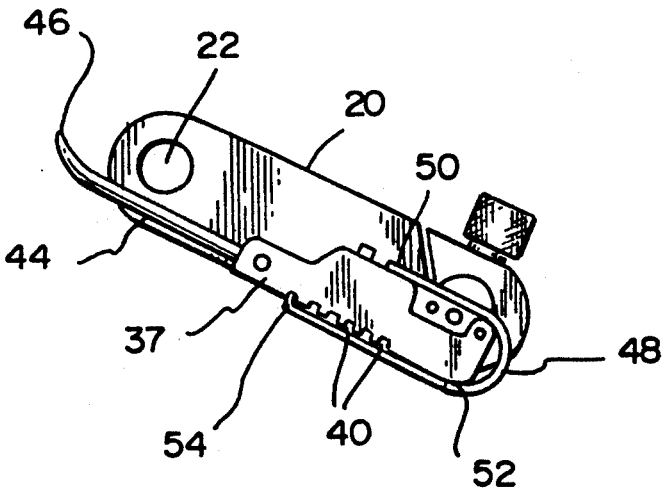
FIG. 7 is a side elevation view showing the improved arrow rest of the present invention wherein the means permitting the archer to control the amount of vertical depressability of the arrow launcher support is in a first position.
Figure 8:
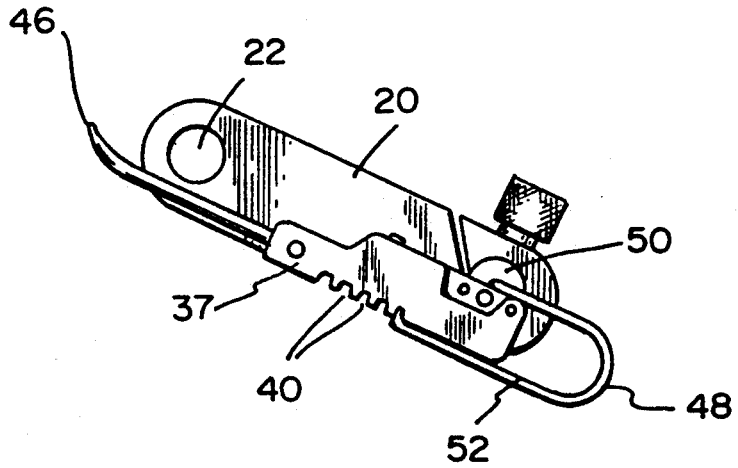
FIG. 8 is a side elevation view showing the improved arrow rest of the present invention wherein the means permitting the archer to control the amount of vertical depressability of the arrow launcher support is in a second position.

It is the position of spring means 48 with respect to arrow launcher support 32 that determines the amount the arrow launcher support 32 will be depressed when the arrow is shot. More specifically, the amount of vertical deflection of arrow launcher support 32 depends upon the particular groove 40 of base member 37 within which finger 54 of spring means 48 is inserted. The more rearwardly the groove 40 within which finger 54 is inserted (as, for example, insertion of finger 54 in the most rearward groove illustrated in FIG. 9A), the lesser will be the amount of vertical depressability of arrow launcher support 32 when the arrow is launched. Conversely, the more forwardly the groove 40 within which finger 54 is inserted (as, for example, insertion of finger 54 in the most forward groove illustrated in FIG. 7), the greater will be the amount of vertical depressability of arrow launcher support 32.

In this manner, the archer may simply adjust the position of the finger 54 within the selected groove 40 of base member 37 to control the amount the arrow launcher support 32 will be depressed when the arrow is launched.

Another embodiment of the spring means is shown in FIG. 9A wherein spring means 48A has an upper portion 50A and a lower portion 52A. A retainer screw 57 is inserted selectively within one of various openings 53 of the lower portion 52A and engages within an opening 55 in the bottom surface of arrow launcher support 32. Here again, it is the position of spring means 48A with respect to arrow launcher support 32 that determines the amount the arrow launcher support 32 will be depressed when the arrow is shot. Specifically, the amount of vertical deflection of arrow launcher support 32 is dependent upon which particular opening 53 is selected for insertion of retainer screw 57. The more rearwardly the opening 53 within which retainer screw 57 is inserted (as, for example, insertion of retainer screw 57 in the most rearward opening 53, illustrated in FIG. 9), the greater will be the amount of vertical depressability of arrow launcher support 32 when the arrow is launched. Conversely, the more forwardly the opening 53 within which retainer screw 57 is inserted (as, for example, insertion of retainer screw 57 in the most forward opening 53, illustrated in FIG. 9), the lesser will be the amount of vertical depressability of arrow launcher support 32.

In this manner, the archer may simply select the opening 53 within which retainer screw 57 is inserted to control the amount the arrow launcher support 32 will be depressed when the arrow is launched.

While the tensioning springs of FIG. 9 and FIG. 9A both employ means of adjusting the loading between the shuttle 29 and the launcher support 32, it is obvious that thickness, width and selection of spring materials will also affect the spring rate and thus the vertical depressability. Accordingly, the vertical depressability of arrow launcher 32 can be controlled by any or all of the mentioned means.

The present invention thus provides a simple, reliable, inexpensive means to allow the archer to control the amount of vertical depressability of the arrow launcher support and thus the degree of oscillation of the arrow during flight. Although the invention has been described and illustrated in detail in the foregoing description and drawings, it should be understood that only the preferred embodiment has been shown and described and that all changes and modifications that come within the spirit of the invention are intended to be protected.

Having thus described the invention, what is claimed as novel and desired to secure by Letters Patent is:

1. An improved arrow rest for an archery bow, comprising:

a vertically depressable arrow launcher support including an arrow support connected to the bow;

means connecting the arrow launcher support to the bow;

spring means in engagement with the arrow launcher support for controlling the amount the arrow launcher support will be vertically depressed when the arrow is launched; and means on the arrow launcher support which cooperate with the spring means to enable the archer to control the amount of vertical depressability of the arrow launcher support and wherein the spring means which controls the vertical depressability of the arrow launcher support includes a finger thereon, and wherein the means on the arrow launcher support which cooperate with the spring means to enable the archer to control the amount of vertical depressability of the arrow launcher support are grooves within which the spring means finger is inserted, and wherein the grooves are located on one or more of the surfaces of the arrow launcher support and wherein the spring means finger is inserted within one such grooves whereby the amount of vertical depressability of the arrow launcher support is controlled by the selection of the particular groove within which the spring means finger is inserted.

2. An improved arrow rest as set forth in claim 1 wherein a retainer screw is inserted through one of a plurality of openings in the spring means and into an opening in a bottom surface of the arrow launcher support whereby the amount of vertical depressability of the arrow launcher support is controlled by the selection of the particular opening in the spring means within which the retainer screw is inserted.

3. An improved arrow rest as set forth in either claims 1 or 2 wherein an arm mounted on the bow connects the arrow launcher support to the bow.

4. An improved arrow rest as set forth in claim 3 including means for moving the arrow launcher support toward and away from the arm.

5. An improved arrow rest as set forth in claim 4 wherein the means for moving the arrow launcher support toward and away from the arm in a rod assembly means.

6. An improved arrow rest as set forth in claim 5 wherein the rod assembly is rotatable for permitting angular adjustability between the arm and the arrow launcher support.

7. An improved arrow rest as set forth in claim 6 wherein the length of the arrow support is adjustable.

* * * * *